United States Patent [19]

Puccio et al.

[11] 3,931,772

[45] Jan. 13, 1976

[54] ARTICLE OF FURNITURE AND METHOD OF MANUFACTURE

[76] Inventors: Paul Puccio; John Puccio, both of 54 Nassau Blvd., Garden City, N.Y. 11530

[22] Filed: Mar. 28, 1973

[21] Appl. No.: 345,809

[52] U.S. Cl. ..... 108/161; 52/724; 248/188.1

[51] Int. Cl.[2] ..... A47B 13/00

[58] Field of Search ..... 297/445, 450, 451; 52/723, 52/724; 108/161; 248/188.1

[56] References Cited

UNITED STATES PATENTS

| | | | |
|---|---|---|---|
| 2,659,422 | 11/1953 | Holland | 297/440 |
| 2,921,463 | 1/1960 | Goldfein | 52/723 |
| 3,392,947 | 7/1968 | Keliehor | 248/188.1 |
| 3,550,339 | 12/1970 | Yanai | 52/724 |
| 3,798,867 | 3/1974 | Starling | 52/724 |

FOREIGN PATENTS OR APPLICATIONS

| | | | |
|---|---|---|---|
| 1,206,128 | 12/1965 | Germany | 248/188.1 |
| 1,220,988 | 7/1966 | Germany | 52/724 |

*Primary Examiner*—Roy D. Frazier
*Assistant Examiner*—Darrell Marquette
*Attorney, Agent, or Firm*—Blum, Moscovitz, Friedman & Kaplan

[57] ABSTRACT

An article of furniture in which a metallic structure is substantially surrounded by stone in the form of marble or onyx. An epoxy resin fills the space between the metallic skeleton structure and the stone covering. The epoxy resin may be poured or injected around the metallic structure and within the exterior covering stone.

6 Claims, 4 Drawing Figures

ARTICLE OF FURNITURE AND METHOD OF MANUFACTURE

BACKGROUND OF THE INVENTION

This invention relates generally to furniture construction and especially to furniture in which a reinforcing skeleton structure is embedded within an exterior structure having stone as the surface covering. While furniture with reinforcing structures have taken various forms, such furniture has not combined, in the past, strength with substantially light weight in the construction of stone furniture. Furniture made of marble or onyx, for example, was heretofore massive and could not be readily moved about or changed in position within a residence, for example, to be practical. Also, a light and airy appearance was not possible. Such massive stone furniture, furthermore, was readily subject to cracking, while in use, due to the relatively low tensile strength properties of such materials.

SUMMARY OF THE INVENTION

Generally speaking, in accordance with the invention, furniture is provided in which the exterior surface is made of stone. Typical stone used for such purposes in the construction of furniture articles, may be in the form of marble or onyx. To avoid the massiveness of furniture constructed from solid stone, the stone is hollowed out and applied over a metallic structure which may be in the form of structural steel elements, for example. The space between the reinforcing structure and the stone serving as the exterior material for the furniture, is filled with an epoxy resin. The epoxy may be either poured or injected into the space or cavity left between the interior hollowed out surface of the stone, and the external surface of the reinforcing metallic structure. The stone structure may be in the form of one integral piece, or be applied in several parts assembled to the reinforcing metallic structure. At the same time, the skeleton metallic structure may be first assembled in place and then covered with the stone, or the stone structure may be first generated or assembled and the steel elements may then be inserted into the hollowed out portions of the stone. The structural reinforcing elements may, thereafter, be linked together by welding, for example, or they may be left within the stone portions detached from each other.

Accordingly, it is an object of this invention to provide articles of furniture in which stone is used as the exterior surface material.

Another object of the invention is to provide furniture constructed of stone, while avoiding the heavy weight and massiveness inherent in stone constructions.

A further object of the present invention is to provide furniture constructed of stone which is relatively low in weight and has substantial tensile strength to avoid cracking of the stone while in use.

Still another object of the invention is to provide furniture constructed of stone in which economical-shaped stone elements are assembled to a metallic reinforcing structure.

A still further object of the invention is to provide an improved method of manufacturing furniture constructed of stone.

Still other objects and advantages of the invention will in part be obvious and will in part be apparent from the specification.

It will thus be seen that the objects set forth above, among those apparent from the preceding description, are efficiently attained and, since certain changes may be made in carrying out the above method and in the article set forth without departing from the spirit and scope of the invention, it is intended that all matter contained in the above description and shown in the accompanying drawing shall be interpreted as illustrative and not in a limiting sense.

BRIEF DESCRIPTION OF THE DRAWINGS

For a fuller understanding of the invention, reference is had to the following description taken in connection with the accompanying drawing, in which.

DESCRIPTION OF THE PREFERRED EMBODIMENTS

Figure 1:
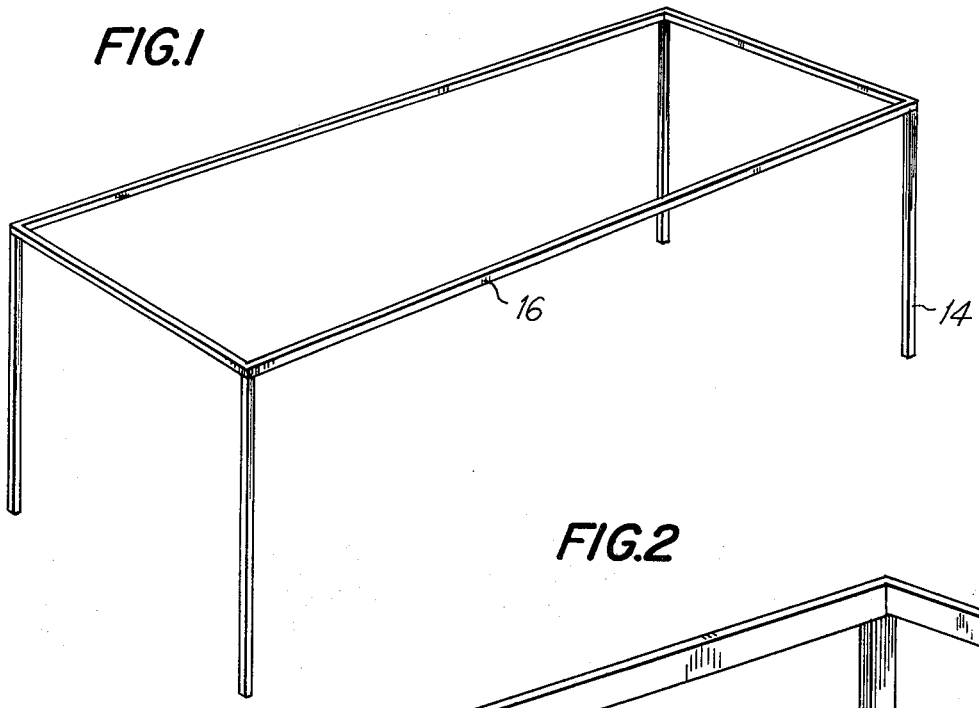
FIG. 1 is a perspective view of the metallic reinforcing structure used in the construction of an article of stone furniture, in accordance with the present invention.
Figure 2:
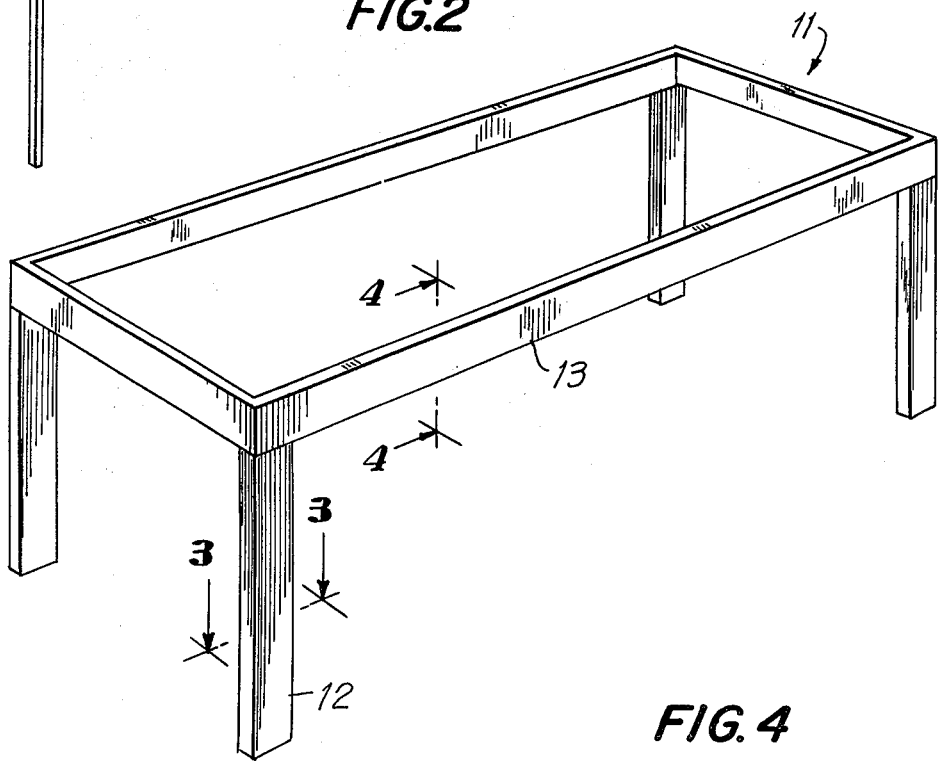
FIG. 2 is a perspective view and shows the external appearance of a stone table when completed using the reinforcing structure of FIG. 1.

Referring now to FIGS. 1 and 2, a table indicated generally at 11 has legs 12 and connecting horizontal side members 13 made of hollow stone material. The legs 12 may be constructed, for example, by boring or milling out a stone slab or structural member, so as to leave a substantial cavity within the stone member. The hollowing out or removal of the interior part of the stone member causes the latter to be relatively light in weight. At the same time, however, the cavity left within the hollow stone member reduces the original tensile strength of the solid stone member. Solid stone such as marble or onyx while being substantially hard, are inherently brittle as a result of their significant hardness properties. The brittleness lowers resistance of the stone structure to cracking or chipping resulting from shocks and exceeding the tensile strength properties of the material. Consequently, while stone has inherently low tensile strength compared to its relatively high compressive strength, hardness and accompanying brittleness, the resistance of the stone structure to cracking is further reduced as a result of the hollowing out process of the stone members to achieve lightness in weight.

To impart strength to the stone structure after hollowing out and generating a substantial cavity within the stone for purposes of reducing the weight thereof, reinforcing metallic elements 14 are inserted within the cavity left in the stone member 12. The metallic element 14, when in the form of steel, for example, will provide the necessary tensile strength to resist cracking of the furniture as a result of applied loads or temperature changes, for example. Thus, when left outdoors throughout the year, for example, the table frame 11 undergoes wide temperature changes when in the northerly part of the globe. Such wide changes in temperature may cause considerable cracking of the stone. Such cracking, however, is substantially resisted and prevented by the structural steel members 14 which apply the necessary added strength to the stone structure.

Surrounding the steel member 14 and within the cavity left within the stone leg 12, is an epoxy resin. This epoxy serves to mechanically link the reinforcing element 14 to the stone structure 12 while, at the same time, firmly embedding the element 14 within the cavity of the leg 12. This epoxy 15 may be either poured into the cavity or it may be injected thereinto.

Figure 3:
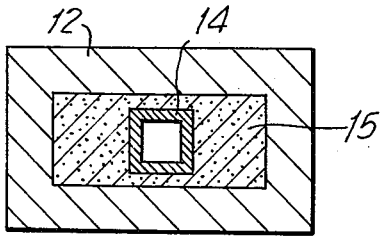
FIG. 3 is a sectional view taken along line 3—3 of FIG. 2.
Figure 4:
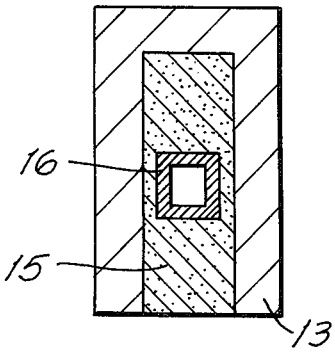
FIG. 4 is a sectional view taken along line 4—4 of FIG. 2.

Whereas the table legs 12 may be in the form in which solid stone members are hollowed out to receive the reinforcing elements 14, the side connecting members 13 may be U-shaped as shown in FIG. 4. As disclosed by the sectional view of this FIG. 4, the underside of this connecting member 13 is not externally covered by stone. Instead, this underside has a substantial epoxy surface. Leaving the underside of the connecting member 13 exposed, in this manner, is of no consequence, since this underside is not normally seen by the user of the furniture when in sitting or standing positions. At the same time, the construction of the U-shaped design of FIG. 4 may be substantially simpler than the hollowed out structure of FIG. 3. Thus, the milling process is simplified when the depth to be milled is substantially shallow. Assuming the mill to be introduced from the exposed underside of the member 13, the depth to be milled for this member 13 is substantially less than the depth to be milled in the leg 13 where the milling cutter is introduced from one end of the leg and must penetrate through the entire length of the leg.

In lieu of the milling or hollowing out processes applied to result in relatively low weight of the stone structure, the leg 12 may be formed of, for example, four rectangular-shaped stone elements cut from a slab or sheet of stone. These four rectangular-shaped sections for the leg 12 may then be assembled together about the epoxy 15 which retains the reinforcing member 14 within its interior. With such design, the leg 12 is made of a plurality of stone elements assembled together rather than of a single integral piece of stone which requires hollowing out. The same principle of assembling separate rectangular-shaped stone elements to epoxy in which structural steel is embedded, for example, may also be applied to the side connecting member 13.

The structural reinforcing member 14 may be in form of the square-shaped tubular element shown in the sectional view of FIG. 3, or it may be in the form of a structural angle shape, or any one of the numerous other conventional structural steel shapes. Such structural shapes have been widely standardized in the form of angles, H sections, I sections, L sections, and a variety of different flanges, for example. The reinforcing member 14, furthermore, may be made of steel, aluminum, or other metallic or reinforcing material.

In the construction of the table frame 11, the leg reinforcing members 14 may first be assembled to the connecting side panel reinforcing members 16. Such assembly of the members 14 and 16 may be achieved by welding, brazing, or any one of the other conventional fastening means. Upon assembly of the members 14 and 16, in this manner, the structure shown in FIG. 1 is obtained. This skeleton reinforcing of FIG. 1 may now be surrounded with the marble or onyx, and the epoxy may be poured or injected within the space left between the skeleton structure of FIG. 1 and the surrounding stone. Alternatively, it is possible to first assemble the hollowed out stone structure, and then to insert reinforcing members 14 and 16 within this stone structure. The reinforcing members 14 and 16 may, thereafter, be mechanically linked as by welding, for example, or they may be left detached within the stone structure. The tensile strength at any cross section of the leg 12 or side panel 13 will not be impaired or reduced, for example, as a result of leaving the members 14 detached from the members 16. Thus, the reinforcing members 14 and 16 contribute or add to the strength of the stone structure even when not directly mechanically fastened together.

Whereas marble and onyx were referred to as the stone materials which may be used in the construction of the table frame 11, other stone materials are equally applicable. With the foregoing construction and fabricating techniques, a limitless range of designs is now possible because long spans and thin sections are now possible. The invention overcomes the prior limitations caused by the low tensile strength and brittleness of stone materials.

It will thus be seen that the objects set forth above, among those made apparent from the preceding description, are efficiently attained and, since certain changes may be made in carrying out the above method and in the article set forth without departing from the spirit and scope of the invention, it is intended that all matter contained in the above description and shown in the accompanying drawing shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A stone covered article of furniture comprising in combination substantially elongated stone members, each of said substantially elongated stone members defining a part of said article of furniture, each said substantially elongated part having a cavity therein, each said cavity having a substantially elongated reinforcing member therein which is spaced from the interior wall thereof; and epoxy means within the space between each said reinforcing member and the associated interior wall of each said stone member defining each said cavity, said reinforcing member being completely surrounded by said epoxy means.

2. The article of furniture as defined in claim 1 wherein said substantially elongated stone member parts form the legs of a table; and at least one substantially elongated horizontal stone member part connected to said legs for forming a table frame, each of said horizontal elongated stone members having a cavity retaining said reinforcing member and said epoxy means.

3. The article of furniture as defined in claim 1 wherein said stone is marble.

4. The article of furniture as defined in claim 1 wherein said stone is onyx.

5. The article of furniture as defined in claim 1 wherein said reinforcing member comprises structural steel.

6. The article of furniture as defined in claim 1 wherein said reinforcing member is a tubular member having a substantially rectangular cross section.

* * * * *